US007350754B2

(12) United States Patent
Pierson

(10) Patent No.: US 7,350,754 B2
(45) Date of Patent: Apr. 1, 2008

(54) BLOCK CONTROLLER

(75) Inventor: Martin D. Pierson, Howell, MI (US)

(73) Assignee: Lionel L.L.C., Chesterfield, MI (US)

( * ) Notice: Subject to any disclaimer, the term of this patent is extended or adjusted under 35 U.S.C. 154(b) by 253 days.

(21) Appl. No.: 11/048,652

(22) Filed: Jan. 27, 2005

(65) Prior Publication Data

US 2005/0184198 A1 Aug. 25, 2005

Related U.S. Application Data

(60) Provisional application No. 60/539,418, filed on Jan. 27, 2004.

(51) Int. Cl.
*B61L 25/00* (2006.01)

(52) U.S. Cl. ..... 246/122 A

(58) Field of Classification Search ..... 246/3, 246/4, 5, 28 R, 31, 62, 63 R, 63 C, 122 A, 246/122 R, 111, 112, 113, 114 R, 1 R, 1 C, 246/120, 121, 128, 129, 34 R, 34 A; 318/280, 318/51; 701/19, 20; 324/217, 218
See application file for complete search history.

(56) References Cited

U.S. PATENT DOCUMENTS 5,555,815 A * 9/1996 Young et al. ..... 104/296
5,638,522 A * 6/1997 Dunsmuir et al. ..... 715/763

* cited by examiner

*Primary Examiner*—Mark Tuan Le
(74) *Attorney, Agent, or Firm*—O'Melveny & Myers LLP

(57) ABSTRACT

An intelligent block controller for a model train is connected to receive detect signals from adjacent blocks of model railway track assemblies indicating that a model train is present on a respective block track assemblies. The controller provides one or more control outputs to automatically and independently control power to selected blocks of track, to operate one or more switches, or to operate other accessories. The detect signal may be provided by grounding an isolated portion of a rail to a ground rail or other voltage reference. The controller may also be configured to accept user input to select a preferred operating mode, or to deactivate automatic control.

9 Claims, 4 Drawing Sheets

BLOCK CONTROLLER

CROSS-REFERENCE TO RELATED APPLICATION

This application claims priority pursuant to 35 U.S.C. § 119(e) to U.S. Provisional Application No. 60/539,418, filed Jan. 27, 2004, which application is specifically incorporated herein, in its entirety, by reference.

BACKGROUND OF THE INVENTION

1. Field of the Invention

This invention relates to model toy train systems generally, and more particularly to an intelligent block controller for model toy train system.

2. Description of Related Art

Model toy train systems have been known generally for decades. More recently, some such systems have adopted sophisticated electronics to provide improved user control and additional features for control. These more modern systems generally provide heightened levels of realism and user satisfaction for the hobbyist.

One basic aspect of model train systems relates to the model train layout, particularly the track layout and the accompanying trackside accessories. As to the track layout, the variations are limited only by the ingenuity of the user, and typically include at least an oval with perhaps an inner oval or circle-shaped portion, turn-outs, side tracks, etc. Layouts often include one or more switches for switching model train traffic onto different portions of the layout. When more than one train is operating on a particular layout, switches are activated by the hobbyist as needed to manage the model train traffic and prevent collisions.

For example, track layouts often include multiple sections of track designed to operate independently, sometimes referred to as a block. A block is a common designation for a length of track with an independently controlled power supply. A layout may include multiple blocks arranged so that two or more trains may operate independently in the layout, each within a designated block. For example, a layout may comprise annular blocks, such as an outer high-speed loop for operating a high-speed train, and an inner loop for operating a slower train. Such blocks are often connected via a switch, to permit movement of trains between blocks.

In any layout for operating multiple trains, a risk of collision may be present at switch points, intersections or other defined locations in the layout. Typically, switches and train movement are managed by manual oversight of the hobbyist to avoid collisions. Many hobbyists would sometimes like multiple trains to operate more autonomously over a complex model layout. It is desirable, therefore, to provide a system for automatic control of model train switching and train movement, to avoid collisions while keeping trains moving around a layout in an orderly fashion. It is desirable that such a system be capable of automatically sequencing trains through switch points or intersections, for example, when two trains approach the same switch point or intersection. It should also be desirable to provide different control modes for such a system, for example, manual control or fully automatic control.

It is further desirable to detect the location of trains in system layouts so as to automatically control static features of the layout. For example, a model highway crossing signal might be automatically activated, or a model drawbridge might be automatically closed, as a model train approaches.

It would also be advantageous for an automatic switch control or location detection system to operate without requiring additional motion control sensors, e.g., mechanical, electrical or optical sensing devices, in the system. Such additional sensors may be less desirable as components of a control system, because they may add additional cost, or may need frequent alignment, maintenance, or repair.

There is thus a need for a block controller that can be easily integrated into existing model train systems, that is easy to use, that has an interface that allows the user to specify basic modes of operation, and which can accomplish one or more of the foregoing control functions.

SUMMARY OF THE INVENTION

The present invention provides a system for controlling movement of one or more model trains within a layout. The system may be configured to make use of a plurality of adjacent blocks of model train track within a model train track layout. A typical model train track layout may have several overlapping or adjoining blocks of track assembly, for example a series of concentric loops or a loop with one or more passing sidings or spurs. Each of these loops, sidings or spurs may be configured as a block assembly, for example by isolating the electrically "hot" rail in a three-rail track system. Each block assembly may also include one or more switches for switching between two alternative routes and one or more accessories, for example, a crossing signal and gate. In addition, more than one model train may be operated on the model train track. Thus, it is necessary to independently control operation of accessories, switches and model train movement on the individual block assemblies to ensure that multiple trains operating on the given model train track layout do not collide.

A system according to the invention provides intelligent, independent control of the plurality of adjacent block track assemblies based on a detection signal input from each of the block assemblies. For example, in a three-rail track configuration where the inside rail is the live or "hot" conductor and the outside rails are the common or neutral conductors for the entire model train layout, a detect signal indicating the presence of a model train within the block assembly may be generated by insulating one of the outside rails of the block section to uncouple it from the common conductor. When the model train enters the block assembly, the metal wheels bridge the outside rails and temporarily ground the insulated rail. The change in electrical state of the outside rail may then be used to generate a detect signal indicating the presence of a train in this block assembly. In addition, the subsequent return of the electrical state from grounded to floating may be used to generate a detect signal indicating that the train has exited the block. This detect signal may be used to determine in which direction the train is traveling, as it exits one block and enters another. In addition, this signal may be used to determine when one train has exited a block so that a train on another block may enter that block.

A plurality of inputs is configured to receive the detection signals from each of the adjacent block sections. Based on the detection signals received from the block assemblies, the system will automatically determine the appropriate movement for each model train in order to prevent two trains from being on the same block. The system will control the movement of each model train within a block assembly by energizing or de-energizing the block assembly. For example, in the three-rail track configuration where the inside rail is the live or "hot" conductor, this "hot" rail may be isolated within the block track assembly by insulating both ends of the third rail within the block assembly. The system may then selectively apply power to a block assembly independent of the power supplied to adjacent block track assemblies. A plurality of power outputs from the system connected to a power source and the third rail of one of each block assemblies enables the system to selectively apply varying power levels to each block assembly. The system may also use detect signals evincing that the train has exited the block assembly, for example, a return of the outside rail to a "floating state" to determine when to de-energize a block assembly. In the alternative, the system may use a pre-determined amount of time or other method for determining when to de-energize a block assembly.

The system may also control the operation or one or more switches within a block assembly by sending a control signal to the switch, causing it to assume either a "thru" (straight) or "out" (curved) position. The system may determine what control signal to send to the switch, based on the plurality of detection signals received from the block assemblies. For example, if the system detects two trains entering adjacent blocks, the system will automatically send a command signal to a switch in one of the blocks to route one of the trains to an alternative route, such as to a siding or alternate loop, and avoid a collision. Again, the system may use either a detect signal signaling the exit of the train from the block assembly or another method for determining when to send a second command signal to the switch to return it to its original position. For example, when a switch is conditioned to the "out" position to transfer a train to a passing siding block to enable another train to pass on the main route, the switch should then be returned to the "thru" position to permit the other train to pass. The system may be configured to generate this command based on a detect signal indicating that the first train has exited the block, a detect signal from the passing siding indicating the presence of the train on its block assembly, a pre-determined amount of time or by some alternative method.

In an embodiment of the invention, the user may further select a desired mode of operation, for example user-override or a specific block priority. Based on the selected mode of operation and the detection signals received from the block track assemblies, the system will automatically determine the appropriate actions for each of the switches, accessories and model trains within each block assembly. For example, the user may prioritize movement in one block over movement in another. In this case, the system will automatically de-energize and energize blocks and generate switch command signals to permit a train in the priority block to pass first. In the alternative, the user may select a mode of operation which requires additional user input to determine the order of operations. Here, the system may automatically act based on the detect signals to avoid having two trains in the same block assembly, for example, by de-energizing both blocks and halting both trains when it detects the presence of trains in adjacent blocks. The system may then await instruction before taking additional action, for example, to allow the user to determine which model train will fit onto the side spur or passing siding.

In addition, the system may control the operation of one or more accessories by determining the appropriate operation of the accessory based on the detect signal of a model train within the given block assembly. The system may compare the detect signal and/or the system response regarding train movement and switch control to a set of user input pre-determined conditions, and send an appropriate control signal to the accessory. For example, the system may be configured to automatically activate a signal or crossing gate when a detect signal indicates the presence of a train in the block assembly. In the alternative, the system may be configured to activate a gate crossing or a signal light when the switch is given a command to the "out" position.

A more complete understanding of the block controller, and of a system for block control, will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provide a system for controlling a model train system, and a block controller for use therewith, that overcomes the limitations of the prior art. In the detailed description that follows, like elements numerals are used to indicate like elements appearing in one or more of the figures.

Figure 1:
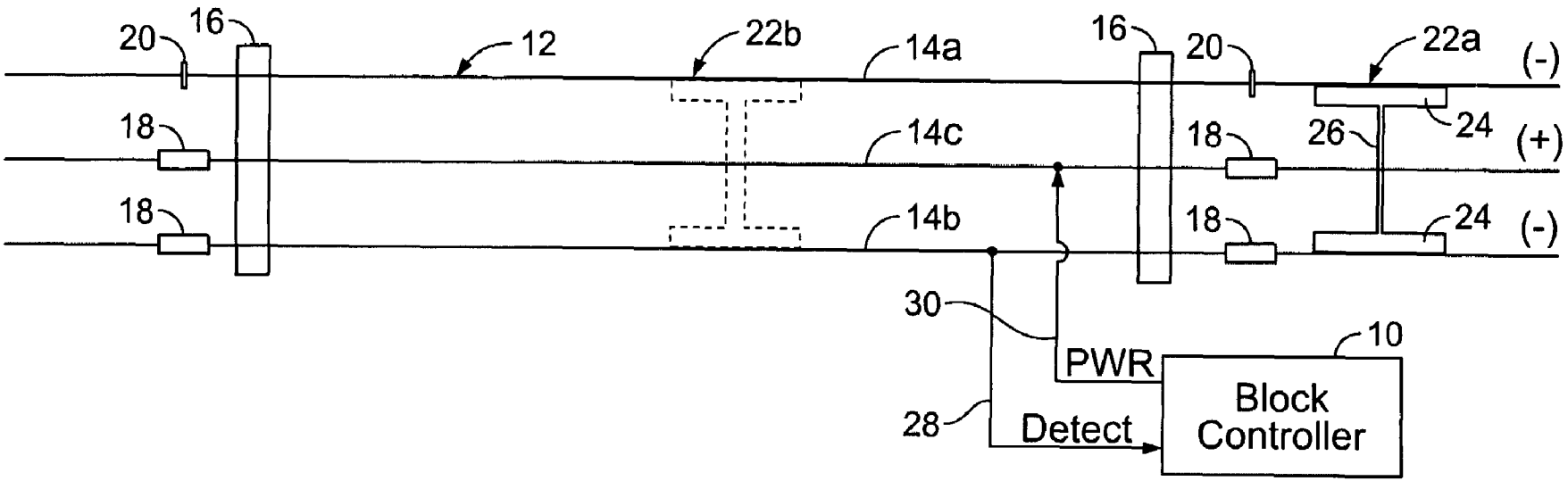
FIG. 1 is a schematic diagram showing an insulated block of model railway track used for detecting the presence of a train.

FIG. 1 is a block diagram showing a block controller 10 in accordance with the present invention, coupled to a section of model train track assembly 12. The arrangement shown in FIG. 1 shows an exemplary arrangement of a system for (1) detecting the presence of a model train, for example a locomotive or rolling stock, on track assembly 12 and producing a detection signal indicating such presence, and (2) controlling the energization of track assembly 12. For example, in 0-gauge model train systems, a three-rail track configuration is commonly employed for carrying supply power to the trains on the tracks (i.e., a pair of outside rails designated 14*a* and 14*b* and a center "third" rail designated 14*c*). In O-gauge, the power is generally alternating current (AC) power, which may be varied by a user from about 0-18 V AC during operation, to control power supplied to the train motor. In some cases, pulse width modulation (PWM) may be used to supply operating power to the model train. In O-gauge, the outside pair of rails 14*a*, 14*b* is typically configured as the common or neutral conductor, and the center or third rail 14*c* is configured as the live (or "hot") conductor.

As shown in FIG. 1, track assembly 12 is coupled to a pair of track sections on both the left and right. Track assembly 12 may further include a plurality of ties 16, only two being shown for illustrative simplicity. Multiple blocks of track assembly may be configured in a model train layout by isolating the third rail—the electrically "hot" rail—between blocks by using, for example, a plastic pin 18 or other insulating mechanical connector at both ends of the third rail 14*c*. Controller 10 may be connected to hot rail 14*c* via line 30, for control of power to a train on the segment between spacers 18.

In addition, track assembly 12 may be configured to provide presence detection signals by likewise isolating either of the outer rails 14*a*, 14*b* using insulating spacers 18. An insulated rail segment may thus be provided in one of the outside rails (14*b* in this instance) between the insulating spacers. Thus, there is a mechanical connection but no electrical connection. Block controller 10 may be connected to insulated rail segment 14*b* between spacers 18 via line 28, and configured to detect when rail 14*b* in this segment is grounded.

The other outside rail (14*a* in this instance) may be electrically and mechanically coupled at both ends with a metal pin 20 or the like. Thus, the outside rail 14*a* is electrically coupled to the corresponding outside rail of the adjacent track sections on both the left and right. In an embodiment of the invention, the outside rail 14*a* of the middle track section may be maintained as the electrical common or neutral (ground) conductor for a model train power circuit. The opposite insulated outside rail 14*b* may be left electrically "floating" when no train is on the track assembly 12. That is, when a metal wheel and axle assembly 22 is not on track assembly 12 between the insulators 18 (as shown in solid line in position 22*a*), the outside rail 14*b* between the insulators is electrically uncoupled to the power supply and thus "floats." When a train enters the insulated rail segment (as shown in dashed-line form in position 22*b*), the metal wheel/axle assembly 22*b* bridges the pair of outside rails 14*a* and 14*b* so that the outside rail 14*b* is no longer floating but is rather grounded (i.e., coupled to the common conductor). The change in rail 14*b* from "floating" to ground may be used to produce a train-presence detection signal that indicates the presence of a train on that track section. If that track section is in a block, the detect signal can also be used as a block detection signal.

In addition, since the third rail 14*c* is electrically isolated, block controller 10 can selectively apply power to track assembly 12 (i.e., the block between insulators 18) via the power signal (designated PWR in FIG. 1). That is, power may be controlled in the block independently of adjacent blocks of track.

Figure 2:
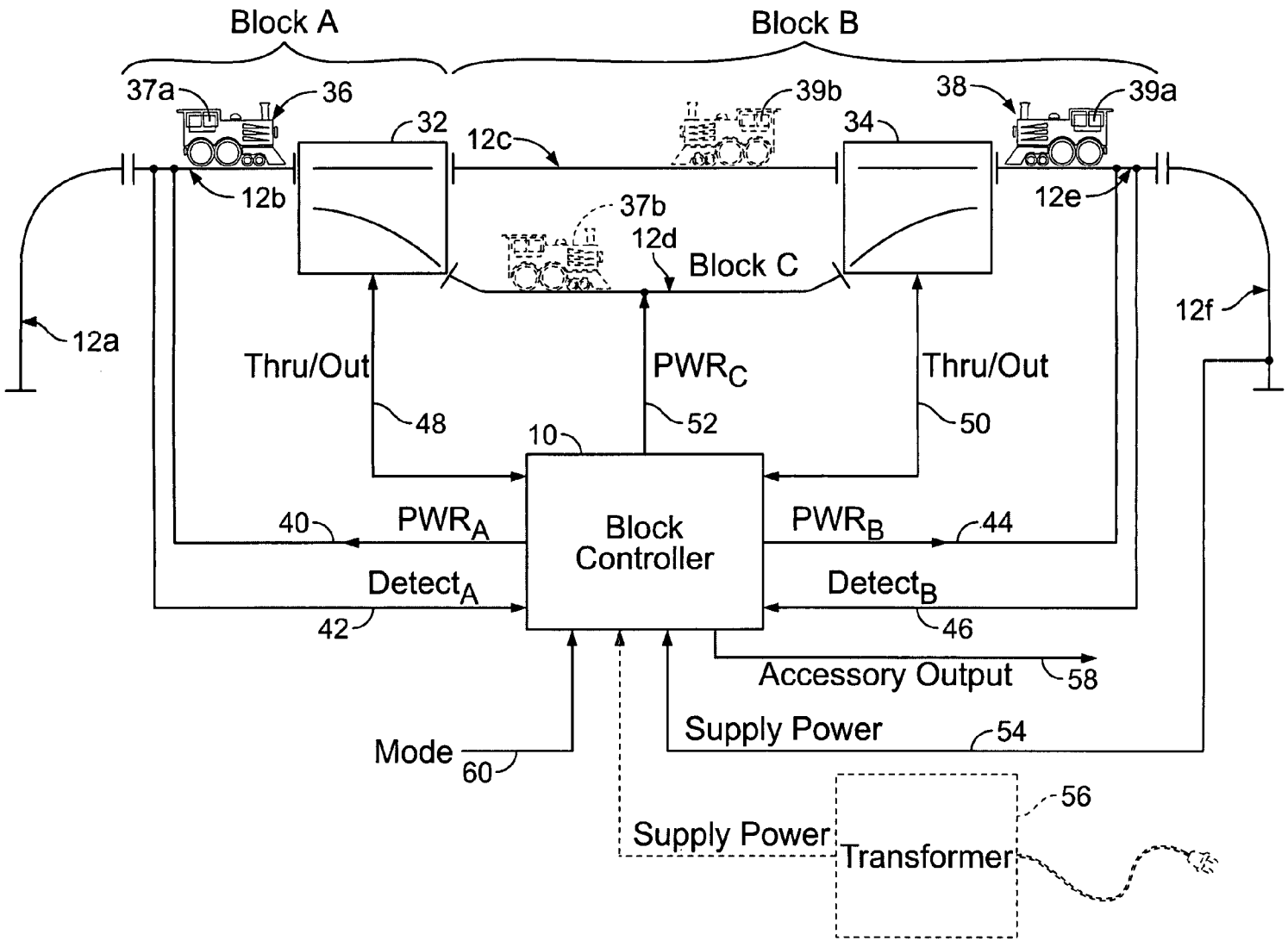
FIG. 2 is a block diagram showing an exemplary embodiment of a block control system in accordance with the present invention.
Figure 3:
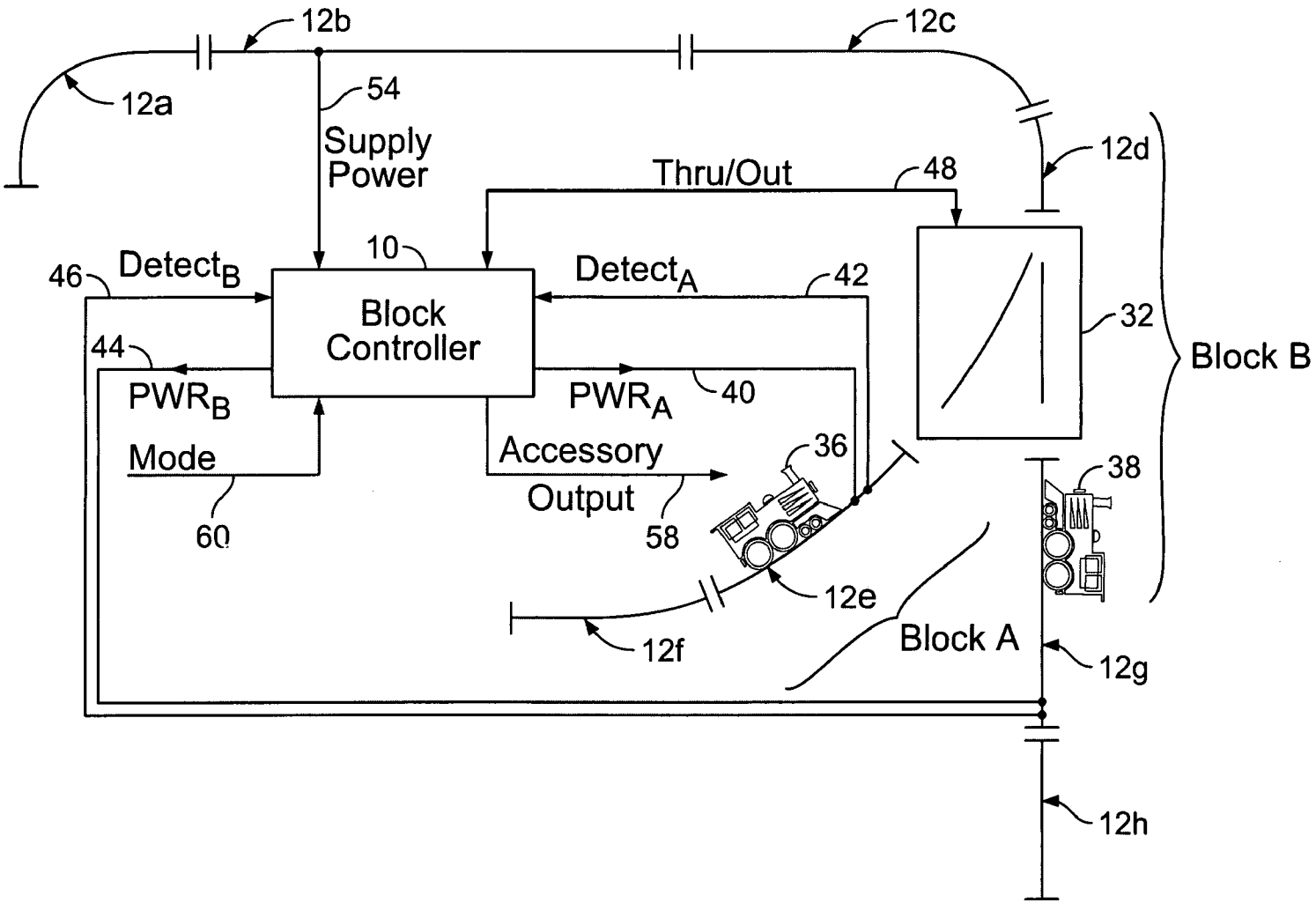
FIG. 3 is a block diagram showing another exemplary embodiment of a block control system in accordance with the present invention.

FIGS. 2-3 show embodiments of the present invention of block control as applied to a train sequencing mode of operation and a block priority mode of operation, respectively. The present invention may use the block detection approach described above in order to implement a low-cost, simple, intelligent block controller. Other block control functions, including, but not limited to other block priority schemes to avoid collisions, are also possible and within the spirit and scope of the present invention.

FIG. 2 is a block diagram of block controller 10 employed in a model train layout. The track sections are only shown as a single line to enhance clarity. It should be understood that in one O-gauge embodiment, the track sections may be constructed using conventional three-rail track assemblies, such as track assemblies 12 shown in FIG. 1.

The system of FIG. 2 exemplifies a mode for controlling the sequencing of two locomotives approaching each other towards a turnout, so that each may pass safely and continue on its route toward its destination. FIG. 2 shows a plurality of track assembly sections designated 12*a*, 12*b*, 12*c*, 12*d*, 12*e* and 12*f*, respectively, left to right (i.e., clockwise). The remainder of the track assemblies that would be required for a complete layout has been omitted for clarity. FIG. 2 also shows a first, right-hand switch 32 and a second, left-hand switch 34. The track assemblies 12 and switches 32, 34 may be arranged into four blocks, designated block A, block B, block C (side track 12*d*) and the main line section of the track layout 12*a*, 12*f*. Block A includes track assembly 12*b* and switch 32. Block B includes track assembly 12*e*, switch 34 and track assembly 12*c*. Block C includes the sidetrack 12*d*. The mainline block includes track assemblies 12*a* and 12*f*. Suitable use of insulators 18 and conductive connectors 20, for example as described above with respect to FIG. 1, are used to ensure that each block is isolated and thus independently controllable by block controller 10.

Switches 32 and 34 are configured to selectively allow "thru" (straight) passage or "out" (curved) passage. Switches 32 and 34 may be conventional components known to those of ordinary skill in the art, for example, O-gauge switches model numbers 602-3010-000 (left hand) and 602-3011-000 (right hand) (nos. "3010" and "3011") available from Lionel L. L. C., Chesterfield, Mich. USA, the assignee of the present invention. In FIG. 2, switches 32 and 34 are responsive to respective thru/out control signals 48 and 50 produced by block controller 10. These signals 48 and 50 condition switches 32 and 34, respectively, to assume the commanded position.

Switches 32 and 34 are electrically actuated switches, in preferred form so as to permit control by block controller 10, and may be either track-powered or powered by a separate and independent accessory transformer (not shown), as known in the art.

FIG. 2 further shows a first model train 36 (shown at positions 37*a*, 37*b*) and a second model train 38 (shown at positions 39*a*, 39*b*), both moving towards each other at positions 37*a*, 39*a*. Block A, as described above, is constructed so as (1) to allow independent powering via a power signal $PWR_A$ on line 40 from block controller 10, and (2) to produce a detection signal $Detect_A$ indicative of when a train, such as train 36, has entered block A (e.g., on track assembly 12*b*). When block A is powered by block controller 10, track assembly 12*b*, and switch 32 are also powered. The block A detection signal $Detect_A$ is provided to block controller 10 on line 42.

Block B is similarly configured so as (1) to allow independent powering via a power signal $PWR_B$ on line 44 from block controller 10, and (2) to produce a block B detection signal $Detect_B$ indicative of when a train, such as train 38, has entered block B (e.g., more specifically on track assembly 12*e*). When block B is powered by block controller 10, track assembly 12*e*, switch 34 and track assembly 12*c* are also powered. The block B detection signal $Detect_B$ may be provided to block controller 10 on line 46.

Block C is the turn-out (side track) and is configured so that it can be independently powered, via a power signal $PWR_C$ produced on line 52 from block controller 10. When block C is powered, only track assembly 12*d* is powered.

The main section of the track layout may be powered by a model train system transformer (not shown) or other suitable power source. It should be understood that the track layout in FIG. 2 is merely exemplary. Variations and different embodiments are clearly possible within the spirit and scope of the present invention.

Block controller 10 may be configured to draw its power from the main line section of track via supply power line 54. In an alternative embodiment, block controller 10 may be configured to draw its power from an alternative power source, such as an AC transformer 56, which may be configured with a standard plug suitable for insertion into a wall outlet (not shown). In either case, block controller 10 may use the supply power to support both internal operations of the circuits in block controller 10, as well as a general power source to independently energize various blocks via power signals 40, 44 and 52.

Block controller 10 may further include an accessory output line 58 that is configured to provide a control signal to an accessory in accordance with predetermined conditions being met. For example, accessory output 58 may be configured to activate an automatic crossing gate or other device, as desired by the user, when a train approaches an intersection. In this case, an insulated block as described herein may be provided in the track at a location where it is desired that the presence of a train activate the accessory. The block may then be connected to a controller in a manner similar to that described above. In this case, however, when the controller receives a detect signal from the insulated block, the controller 10 provides an accessory output on line 58 to activate the accessory. In addition, power may also be controlled to this block, as may operation of a switch, by suitably connecting to and configuring controller 10.

Block controller 10 may further include an input 60 to receive a mode select signal. Mode select input 60 may be used to indicate a user-selected mode of operation of block controller 10. In the system of FIG. 2, the mode of operation of block controller 10 is to selectively energize or de-energize blocks A, B and C, so as to allow one train to safely pass the other train while allowing each to continue on its own route. It should be appreciated that other modes of operation are also possible, such as block A priority mode, block B priority mode, block N priority mode, user-override priority, etc.

In operation, it can occur that two trains, namely, trains 36 and 38, approach each other from opposite directions. When train 38 first enters block B, for example, by entering track assembly 12*e* at position 39*a*, its wheels/axle assembly bridges the outer rails thus generating the block B detection signal $\text{Detect}_B$, which is provided to block controller 10. Block controller 10 is responsive to detection signal $\text{Detect}_B$ to de-energize block B by discontinuing the power signal $\text{PWR}_B$ to track assembly 12*e*. Train 38 thus comes to a halt at position 39*a*.

The other train 36 approaches and enters block A, for example, by entering track assembly 12*b*, wherein its wheel/axle assembly bridges the outer rails of the track, thus producing the block A detection signal $\text{Detect}_A$, which is provided to block controller 10. Block controller 10 is responsive to the detection signal $\text{Detect}_A$ to de-energize block A by removing power via discontinuing the power signal $\text{PWR}_A$ to track assembly 12*b*. Train 36 thus comes to a halt at position 37*a*.

Block controller 10, in accordance with the mode select input 60, decides which train 36 or 38 is to pass first through the interchange. For example, if a user-override priority mode has been selected and provided, e.g., via mode select input 60, into block controller 10, the user may observe how long or how many cars each train 36, 38 has and then decide which one will fit onto the side track and select it.

For example, if train A is to go first, block controller 10 may be configured to (1) assert the thru/out signal 48 so as to condition switch 32 to assume the "out" position; (2) apply the power signal $\text{PWR}_A$ to energize block A; and (3) apply the power signal $\text{PWR}_C$ to energize block C—the side track. These conditions cause train 36 to move from position 37*a* to position 37*b* on the side-track (shown in dashed-line form), at which time block controller 10 is further configured to de-energize block C by discontinuing application of the power signal $\text{PWR}_C$. Block controller 10 may be configured to determine when train 36 has exited block A and has completely entered block C by using the block A detection signal $\text{Detect}_A$. Here, the block A detection signal $\text{Detect}_A$ would be triggered by the return of the outside rail to a "floating" position, i.e., an uncoupled electrical state, thus signaling the exit of the train from block A. It should be understood that other methods are possible for determining when to de-energize block C. For example, once train has exited block A, block controller 10 may be configured to delay a predetermined amount of time and then de-energize block C.

After block C—the sidetrack—has been de-energized, block controller 10 may then be further configured to (1) assert the thru/out signals 48 and 50 so as to condition switches 32, and 34 to assume the "thru" (straight) position; (2) energize block B via applying the power signal $\text{PWR}_B$ to track assembly 12*e*, and (3) energize block A via applying the power signal $\text{PWR}_A$ to track assembly 12*b*. These conditions cause train 38 to move from position 39*a* to position 39*b* (shown in dashed-line form). Note that train 38 needs block A to be energized so that it can move through and beyond block A to continue with its route. Since train 36 is now on block C and off of block A, energizing block A does not affect train 36.

Once train 38 has safely moved on with its route, for example, by entering and then exiting block A, block controller 10 is configured to release train 36. Note, that due to the availability of the block detection signal for block A, i.e., the $\text{Detect}_A$ signal, block controller 10 can be configured to determine when train 38 has safely moved through block A and on with its route. Of course, other detection methodologies are available. At this time, block controller 10 is further configured to (1) assert the thru/out signal 50 so as to condition switch 34 to assume the "out" (curve) position; (2) energize block C—the sidetrack; and (3) energize block B. These conditions cause train 36 to move away from its position at 37*b* on the sidetrack in a generally left-to-right direction (i.e., clockwise), and continue with its route. Controller 10 is configured to energize block B because train 36 needs block B to be energized to get through and beyond block B and on with its route. After train 36 has exited block B, block controller 10 is further configured to assert the thru/out signal 50 so as to condition switch 34 to assume the thru position. In addition block controller 10 may be configured to follow predetermined speed profiles for energizing the tracks and thus the model trains. These profiles may be based on, for example, the then-prevailing mainline track voltage in combination with predetermined mapping data (e.g., percentages of the maximum available).

FIG. 3 is a block diagram showing another embodiment of block controller 10, operating in a block priority mode of operation. The components are the same as in FIG. 2, other than only two blocks are shown, block A (i.e., track assembly 12*e*) and block B (i.e., track assembly 12*g*, switch 32, and track assembly 12*d*). In the system of FIG. 3, the outer oval of the track layout—that which contains block B—may be considered the "fast" route of the layout, and given priority over block A. Block A may comprise, for example, a branch section of track where model trains run at slower speeds. In this embodiment, the user may input a mode select signal 60, which configures block controller 10 to operate in the block B priority mode.

In operation, when trains 36 and 38 both approach switch 32, and enter track assemblies 12*e* and 12*g*, the block A and block B detection signals $\text{Detect}_A$ and $\text{Detect}_B$ are produced and are provided to block controller 10. Block controller 10 is configured to respond by (1) de-energizing block A by discontinuing the power signal $\text{PWR}_A$ via line 40; and (2) asserting the "thru/out" signal 48 to condition switch 32 to assume the "thru" (straight) position. The effect is that train 36 comes to a halt on track assembly 12*e*, while train 38 remains energized and is allowed to pass through switch 32.

Once block controller 10 determines that train 38 has exited block B (e.g., by using the block B detection signal $Detect_B$, as described in connection with FIG. 2 above), block controller 10 is further configured to (1) assert the "thru/out" signal 48 so as to condition switch 32 to assume the "out" (curve) position; and (2) energize block A by applying the power signal $PWR_A$ to track assembly 12*e*. These conditions cause train 36 to move away from track assembly 12*e* through switch 32 and through (and beyond) block A to continue its route. This is just another example of a mode of operation in which block controller 10 can be configured to operate.

Figure 4:
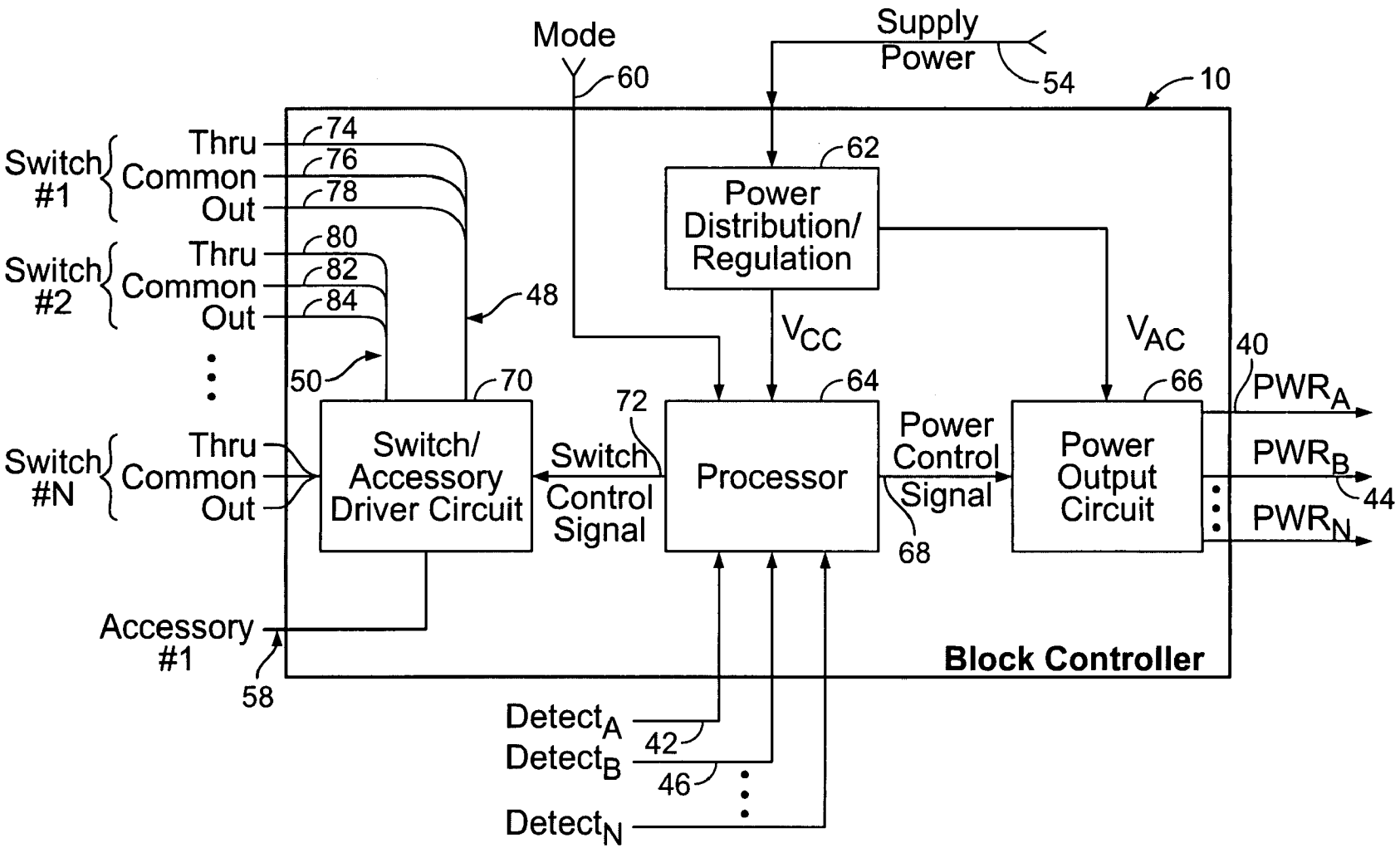
FIG. 4 is schematic diagram showing, in greater detail, an exemplary block controller according to the invention.

FIG. 4 is a schematic and block diagram showing, in greater detail, an exemplary block controller 10. Block controller 10 includes a power distribution and regulation circuit 62, a processor 64, a power output driver circuit 66 responsive to a power control signal 68, and a switch/accessory driver circuit 70 responsive to a switch control signal 72.

Circuit 62 is configured to provide a regulated voltage output ($V_{cc}$) suitable for powering processor 64. Circuit 62 is further configured to pass supply power 54 ($V_{AC}$) to power output circuit 66 for distribution to various independent blocks. Circuit 62 may comprise conventional components and circuits as known to those of ordinary skill in the art. For example, for the voltage regulation function, circuit 62 may include conventional voltage regulation devices.

Processor 64 is configured to implement the functionality of the block control logic, i.e., detection, command and control, and generation of appropriate control outputs as exemplified in the previous embodiments. This implementation is preferably achieved through programmed logic (i.e., software, data). Accordingly, processor 64 may include conventional portions known in the art for such purposes. For example, processor 64 may include a core processing unit, random access memory (RAM), programmable non-volatile memory (e.g., flash memory), suitable input/output pins, and analog-to-digital (A/D) inputs and the like. Processor 64 may comprise any suitable controller, PLC or logic device, for example, a Motorola 68HCxx series micro controller. It should be understood that programming the functionality described herein, having possession of the description contained herein, would require no more than routine skill in the art.

Power output driver circuit 66 is configured to produce a plurality of block power signals 44, i.e., $PWR_A$, $PWR_B$, . . . $PWR_N$, in response to a power control signal 68. In one embodiment, power output circuit 66 comprises triac devices wherein the power control signal 68 corresponds to a phase conduction angle for each block. The use of triac devices controlled by a phase conduction angle signal to obtain a desired output power level is known in the model train art, as seen by reference to U.S. Pat. No. 5,251,856 entitled MODEL TRAIN CONTROLLER FOR REVERSING UNIT and U.S. Pat. No. 5,441,223 entitled MODEL TRAIN CONTROLLER USING ELECTROMAGNETIC FIELD BETWEEN TRACK AND GROUND, both hereby incorporated by reference in its entirety. Through the foregoing mechanism, precise power levels can be applied to any particular block of the track layout independently of the power prevailing on any other block. Other implementations are possible using other known technologies (e.g., power MOSFET implementation).

Switch/accessory driver circuit 70 is responsive to a switch control signal 72 generated by processor 64 for generating downstream signals suitable for controlling or conditioning track switches to assume desired positions, e.g., "thru" or "out". When the switches (e.g., switches 32, 34) are conventional track switches, a group of signals designated THRU, COMMON and OUT may be used to accomplish the desired function. Structure for accomplishing this function is known in the art, and may comprise conventional electromechanical switches (e.g., relays), or more preferably, conventional semiconductor switches capable of sinking an actuation current.

In the illustrated embodiment, conventional track switches are used, which are generally powered locally to that switch (i.e., either via the track power or via an accessory transformer). In this case, the control circuit 70 may be configured to provide to the switch a path(s) to ground in order to accomplish the actual switching. For example, when it is desired to put the track switch in a "thru" (straight) position, the THRU line (i.e., line 74 in FIG. 4) may be taken to ground by circuit 70, functioning to sink the actuation current of the train track switch and causing the track to assume the "thru" (straight) configuration. The OUT (curve) position works the same way. In this embodiment, the function performed by switch drive circuit 70 may be similar to that performed by commercially available components such as Model No. SC-2 switch and accessory unit, available from Lionel L.L.C., Chesterfield, Mich. USA. However, the SC-2 unit also functions as a command-and-control device, and its command-and-control functions are not needed in conjunction with the embodiment of controller 10 described herein.

In addition to switches, various accessories may be connected to accessory output 58 and controlled in any suitable fashion. One of ordinary skill may configure driver circuit 70 to drive a variety of accessories such as used in model train layouts, as known in the art. In such case, circuit 70 may be configured to receive an accessory control signal or command from processor 64, and generate an appropriate output for causing an attached accessory to operate as commanded. Although only a single accessory output 58 is shown, it should be apparent that multiple accessory outputs may also be desirable.

Having thus described a preferred embodiment for a system for block control in a model train track layout, it should be apparent to those skilled in the art that certain advantages within the system have been achieved. It should also be understood that various modifications, adaptations and alternative embodiments thereof may be made within the spirit and scope of the present invention. For example, the invention is not limited to O-gauge model train systems, but can be practiced on other gauge systems (e.g., HO-gauge, etc.). The present invention is also not limited to AC track power system, and may be adapted for use with suitably-configured DC systems as well. Moreover, the present invention is not limited to conventional control arrangements, and may be extended to command control systems (e.g., TRAINMASTER command control TMCC). Moreover, the invention is not limited to a processor/software-based block controller, but may be practiced employing hardware equivalents. The invention is defined by the following claims.

What is claimed is:

1. A system for automatically controlling movement of a model train within a model train track assembly, the system comprising:

a length of model railway track comprising plural mechanically connected blocks of track, the model track comprising a first rail divided into electrically isolated first rail segments, a second rail configured to be electrically conductive along the entire length of the model railway track, and a third rail divided into electrically isolated third rail segments, corresponding ones of the first and third rail segments comprising part of a respective one of the connected blocks, the second rail being electrically grounded and the third rail segments being connected to respective power sources;

a model train car having an electrically conductive axle configured to provide a presence detection signal caused by an electrical connection between one of the first rail segments and the second rail of the model track when the train car is on a corresponding one of the blocks of the model track; and a controller connected to the blocks of track, the controller configured to detect the presence detection signal in the corresponding one of the blocks, and to provide a control output in response to the presence detection signal reflecting presence of the model train car on the corresponding one of the blocks;

wherein, the presence detection signal is electrically isolated from the power sources.

2. The system of claim 1, further comprising a switch disposed with the length of model railway track to switch between adjacent blocks of track.

3. The system of claim 2, wherein the controller is configured to provide the control output operative to operate the switch.

4. The system of claim 1, wherein the third rail comprises an inner rail of the at least three rails.

5. The system of claim 1, wherein the controller is configured to control electrical power for model trains to the individual electrically isolated rail segments of the third rail from the respective power sources.

6. The system of claim 5, wherein the controller is configured to provide the control output operative to control the electrical power.

7. The system of claim 5, wherein the controller is further configured to regulate the electrical power based upon pre-determined speed profiles for the model train track assembly.

8. The system of claim 1, wherein the controller is configured to provide the control output operative to control a static accessory of the model train track assembly associated with the at least one block of track.

9. The system of claim 1, wherein the controller is further configured to accept a user input specifying an operating mode, and to determine the control output based on the operating mode.

* * * * *